United States Patent [19]

Mittelstadt

[11] 4,290,601

[45] Sep. 22, 1981

[54] WOBBLE PLATE EXERCISE DEVICE AND TOY

[76] Inventor: Robert A. Mittelstadt, 15117 Orchard Dr., Burnsville, Minn. 55337

[21] Appl. No.: 25,890

[22] Filed: Apr. 2, 1979

Related U.S. Application Data

[63] Continuation of Ser. No. 799,544, May 23, 1977, abandoned, which is a continuation of Ser. No. 600,637, Jul. 31, 1975, abandoned.

[51] Int. Cl.[3] ..... A63B 23/04; A63G 1/12

[52] U.S. Cl. ..... 272/146; 272/33 R

[58] Field of Search ..... 272/1 R, 30, 33 R, 35, 272/50, 51, 96, 97, 111, 114, 120, 146, 43–46; 273/86 C; 128/24 R, 25 R, 25 B; 280/205, 217; 74/572

[56] References Cited

U.S. PATENT DOCUMENTS

| | | | |
|---|---|---|---|
| 1,150,245 | 8/1915 | Bramkamp | 272/50 |
| 1,254,694 | 1/1918 | Humphries | 74/572 |
| 1,409,071 | 3/1922 | Veaux et al. | 272/35 |
| 1,565,484 | 12/1925 | McWhirter | 272/146 |
| 2,002,561 | 5/1935 | Wike | 74/572 X |
| 2,141,233 | 12/1938 | Alexander | 280/217 |
| 2,256,001 | 9/1941 | Titus | 272/146 |
| 2,517,324 | 8/1950 | Kurose | 273/86 C |
| 2,533,368 | 12/1950 | Hansen et al. | 272/33 R |
| 2,657,055 | 10/1953 | Dehham | 272/97 |
| 2,827,894 | 3/1958 | Meyers | 128/25 B |
| 2,862,710 | 12/1958 | Lewis | 272/33 R |
| 3,063,714 | 11/1962 | Krauss | 272/146 |
| 3,084,935 | 4/1963 | Brown | 272/50 X |
| 3,100,639 | 8/1963 | Bonewitz | 272/146 |
| 3,226,117 | 12/1965 | Walklet | 272/123 |
| 3,269,746 | 8/1966 | Jonker | 272/146 X |
| 3,512,774 | 5/1970 | Honer | 272/146 |
| 3,761,084 | 9/1973 | Dieckmann | 272/146 X |
| 3,806,116 | 4/1974 | Malmberg et al. | 272/146 |

FOREIGN PATENT DOCUMENTS

| | | | |
|---|---|---|---|
| 643031 | 6/1962 | Canada | 272/33 R |
| 832295 | 6/1938 | France | 272/97 |
| 21686 | of 1911 | United Kingdom | 272/50 |
| 439871 | 9/1934 | United Kingdom | 272/146 |
| 716219 | 9/1954 | United Kingdom | 272/50 |

*Primary Examiner*—Richard J. Apley
*Attorney, Agent, or Firm*—Thomas A. Lennon

[57] ABSTRACT

Apparatus is disclosed having a circular wobble plate centrally mounted to a base plate via a spherical bearing. A roller assembly is attached about the center mounting point and radially projects intermediate the wobble plate and base plate to create a raised position of one portion of the wobble plate so that weight displacement atop the wobble plate will cause the wobble plate raised position to angularly rotate relative to the base plate.

15 Claims, 8 Drawing Figures

WOBBLE PLATE EXERCISE DEVICE AND TOY

This application is a continuation of applicant's prior co-pending application Ser. No. 799,544, filed May 23, 1977, now abandoned, which is a continuation of Ser. No. 600,637, filed July 31, 1975, now abandoned.

BACKGROUND OF THE INVENTION

This invention relates to a multiple use apparatus which has utility both as an exercise device and as an amusement device. The apparatus is propelled by the body, principally the muscles of the legs, and it imparts a novel and unique reciprocating, rotating, and wobble motion to the person who operates it. As an exercise device the apparatus strengthens and develops the muscles of the legs and lower torso, and it may have a theapeutic exercising effect for certain medical conditions which may exist in the muscles. As an amusement device, the novel motion creates a stimulating and exciting ride, and skills can be developed to improve the excitement of the ride.

The apparatus may be used in the home, office, hospital or outdoors, depending upon the purposes and results desired. It occupies relatively little space and can be operated quietly. It is an attractive toy to children, and the basic technique of its use becomes immediately apparent to chldren even at the pre-school age level. It may be used either alone or in combination with other similar devices to create various games and play activities.

The apparatus develops an improved sense of balance in anyone who uses it, and particularly it is helpful in developing a sense of balance for activities such as skiing. The unique motion associated with the invention causes the lower body to outwardly flex relative to the upper body, similar to the motion experienced in downhill skiing, and enables the user to practice maintaining his upper body in a fixed position despite wide ranging movement of the legs and knees. Because it causes the muscles in the legs to flex and contract, it tends to strengthen and develop these muscles after only a relatively short period of usage.

SUMMARY OF THE INVENTION

The invention comprises a circular wobble plate pivotally and rotatably fastened at is center to a baseboard, wherein an intermediate roller assembly raises an edge of the wobble plate relative to the baseboard. The roller assembly is rotatably attached to the same center point and has one or more wheels radially displaced therefrom to support and space the wobble plate relative to the baseboard. When a person stands on the wobble plate and shifts his weight relative to the baseboard center point, a rotating motion is imparted to the roller assembly. By shifting weight on the wobble plate in a smooth manner and in a circular path, a person may cause the roller assembly to rotate in either a clockwise or a counterclockwise direction. If the wobble plate is of sufficient mass, a natural flywheel effect may be noted. This flywheel effect causes the wobble plate to smooth out a person's uneven weight shift pulses. In practice, it is impractical to design an exercise machine with wobble plate mass of such great relative weight as to effect smooth operation of the roller assembly. Therefore, the preferred embodiment has a flywheel wherein the mass is concentrated at the radial or diametral extremes of the machine thereby accomplishing the objective of smoothing out variations in force applied by the operator while retaining advantage of minimal weight.

The relative angular rotational speed, and direction of rotation, may be controlled by design of the respective components of the invention as well as by the energy imparted by the operator. In the preferred design, the wobble plate upon which the operator is standing rotates in the opposite direction from flywheel rotation and at an approximate ratio of 12:1 reduction in angular rotational speed. One "wobble" of the wobble plate produces approximately 30° angular travel of the wobble plate in opposite direction to flywheel travel. The relative angular rotational speeds, and directions of flywheel and wobble plate travel, the angular displacement of the wobble plate in relationship to horizon, and the input energy required from the operator may be controlled by design of the respective components of the invention. Additionally, the wobble plate may be designed to remain fixed in as much as it is wobbled thereby eliminating operator rotation altogether.

DESCRIPTION OF THE PREFERRED EMBODIMENTS

Figure 1:
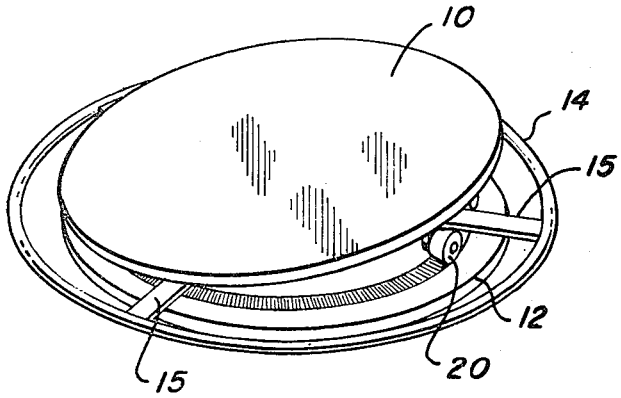
FIG. 1 illustrates an isometric view of the invention.
Figure 6:
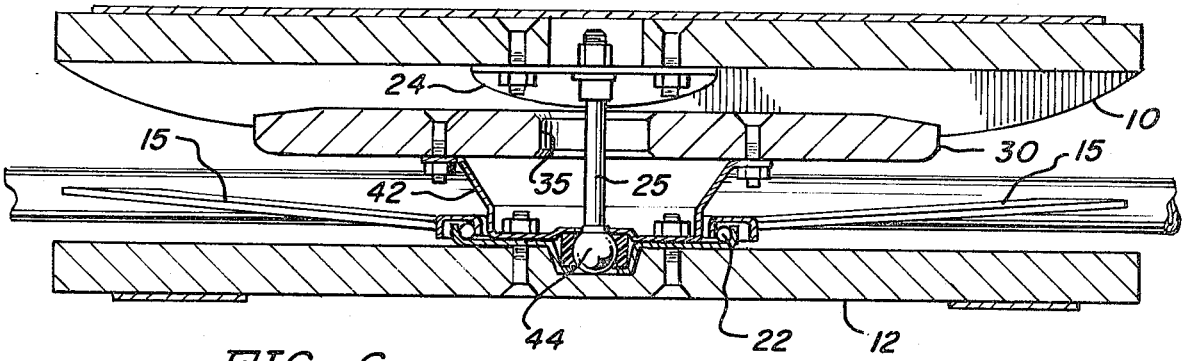
FIG. 6 illustrates a cross sectional view taken along the lines 6—6 of FIG. 3.

Referring first to FIG. 1, the invention is shown in isometric view. A wobble plate or treadle board 10 is centrally attached to a base 12 by means of a rigid shaft 25 and spherical ball bearing 44, as seen in FIG. 6. A flywheel 14 is also centrally mounted about the same shaft by means of radial spokes 15. A roller assembly 16 is attached to one of the flywheel spokes 15 and serves to space apart treadle board 10 and base plate 12 at its position. The central mounting point of flywheel spokes 15 is made by means of a suitable bearing assembly 22 so that flywheel 14 and the attached roller assembly is freely rotatable about the center shaft.

If a person stands atop treadle board 10 and evenly distributes his weight about the center of the treadle board, the treadle board will remain stationary as will flywheel 14. If the person distributes his weight unevenly in any direction from the treadle board center point, a net downward force will be imparted to the treadle board on one side of the roller assembly or the other, and this will cause the roller assembly and flywheel 14 to rotate in a direction away from this net downward force. As soon as such rotation occurs the circumferential point of separation between treadle board 10 and base 12 moves and treadle board 10 adopts a new angular displacement relationship relative to base plate 12. If the person standing atop treadle board 10 continues to shift his weight to follow this relative angular movement of the roller assembly the treadle plate will undergo a wobble motion as the flywheel rotates about the center axis.

Figure 2:
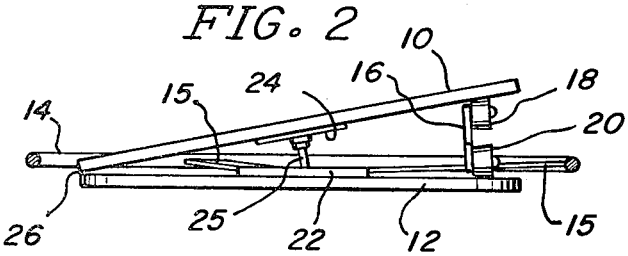
FIG. 2 illustrates one embodiment of the invention in side view.

FIG. 2 illustrates the apparatus of FIG. 1 in side view. The roller assembly 16 is rigidly attached to a radial spoke 15, which in turn is freely rotatable about the center by means of a suitable bearing assembly 22. Roller assembly 16 has one or more lower rollers 20 attached so as to contact the upper surface of base plate 12. Roller assembly 16 also has one or more upper rollers 18 arranged to contact the under side of treadle board 10. The relative spacing of rollers 18 and 20 creates an angular inclination of treadle board 10 relative to base plate 12. This angular inclination may be selected to meet the particular needs or requirements of a user. I have found that an angular inclination of $10° \pm 5°$ results in a satisfactory operation of the apparatus. The center shaft 25 is preferably rigidly attached to the undersurface of treadle board 10 by means of a mounting plate 24. Mounting plate 24 may be screwed to the undersurface, or may be attached by any other convenient attaching means. In the embodiment illustrated in FIG. 2, treadle board 10 is always in contact with base plate 12 at contact point 26, which is diametrically opposite the position of roller assembly 16. Contact point 26 obviously moves angularly in synchronism with the rotation of flywheel 14 and roller assembly 16.

Figure 3:
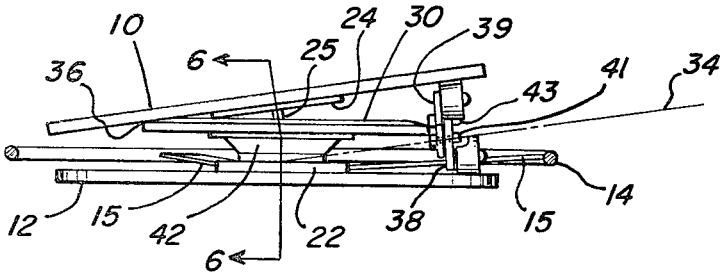
FIG. 3 illustrates a second embodiment of the invention in side view.

FIG. 3 illustrates an alternative embodiment in side view, wherein an additional support disk 30 is provided intermediate treadle board 10 and base plate 12. Support disk 30 is rigidly attached relative to base plate 12, and has a large center opening through which shaft 25 may freely pass. With this embodiment, treadle board 10 is spaced away from base plate 12 and contacts support disk 30 at contact point 36. This arrangement provides some additional protection for users of the apparatus, as contact point 36 is recessed under treadle board 10 and provides a lesser risk of contacting the user's fingers. In the embodiment of FIG. 2, there is some possibility for a user to place his fingers around treadle board 10 and thereby have them squeezed between treadle board 10 and base plate 12 when contact point 26 rotates to the position of the fingers.

Figure 4:
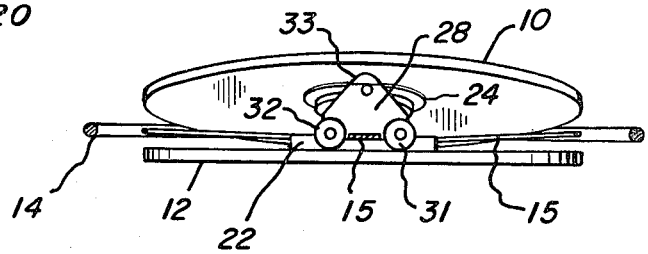
FIG. 4 illustrates a further side view of an alternate embodiment of the invention.

FIG. 4 illustrates a side view of the apparatus having a roller assembly 28 with two lower rollers 31 and 32, and a single upper roller 33. In the illustration upper roller 33 is mounted inwardly from roller assembly 28 and lower rollers 31 and 32 are mounted outwardly. This mounting configuration may be modified if desired.

Figure 5:
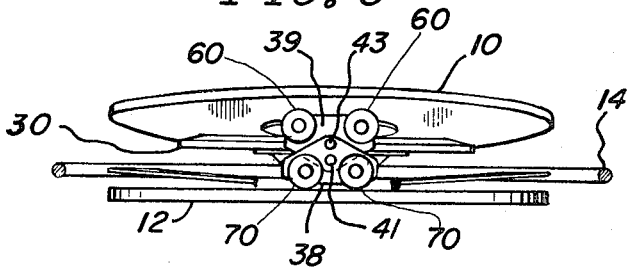
FIG. 5 illustrates yet another side view of the embodiment of FIG. 3.

FIG. 5 illustrates another side view of the apparatus of FIG. 3, wherein the roller assembly has four rollers (two upper rollers 60 and two lower rollers 70) attached thereto. This construction provides a somewhat greater stability of treadle board 10 relative to support disk 30, than does a three-roller assembly. The roller assembly comprises a lower roller frame 38 rigidly attached to a radial spoke 15, and an upper roller frame 39 which is pivotally mounted at pivot pin 41 to lower roller frame 38. Pivot pin 41 is radially aligned relative to the center of base plate 12 along center line 34 (see FIG. 3). Center line 34 is a radial projection from the center of the spherical bearing in base plate 12, and aligning pivot pin 41 along this line creates the proper tracking relationship of the upper rollers against the treadle board 10 lower surface.

A bushing 43 is connected between upper roller frame 39 and lower roller frame 38 by a suitable bolt fastener. Bushing 43 is preferably made of rubber, of preselected durameter, to provide a flexible damper for the pivot motion permitted by pivot pin 41. Bushing 43 and pivot pin 41 together provide a limiting degree of freedom of angular motion about center line 34 to respond to varying loading effects on treadle board 10.

FIG. 6 illustrates a view taken along the lines 6—6 of FIG. 3. This views shows the structural detail of the center portion of the apparatus. A dish-shaped bracket 42 is bolted to the upper surface of base plate 12 and serves as a mounting support for support disk 30. Base plate 12 and support disk 30 therefore become a rigid assembly by means of the attachment of bracket 42.

Shaft 25 is rigidly attached to mounting plate 24 which is in turn bolted to the under side of treadle board 10. The lower end of shaft 25 is formed into a spherical bearing 44 which is seated in an appropriate and suitable bearing assembly on base plate 12. Shaft 25 is therefore rotatable and pivotal about spherical bearing 44. It should be noted that support disk 30 has an interior diameter 35 which is large enough to permit the necessary pivotal motion of shaft 25.

Figure 7:
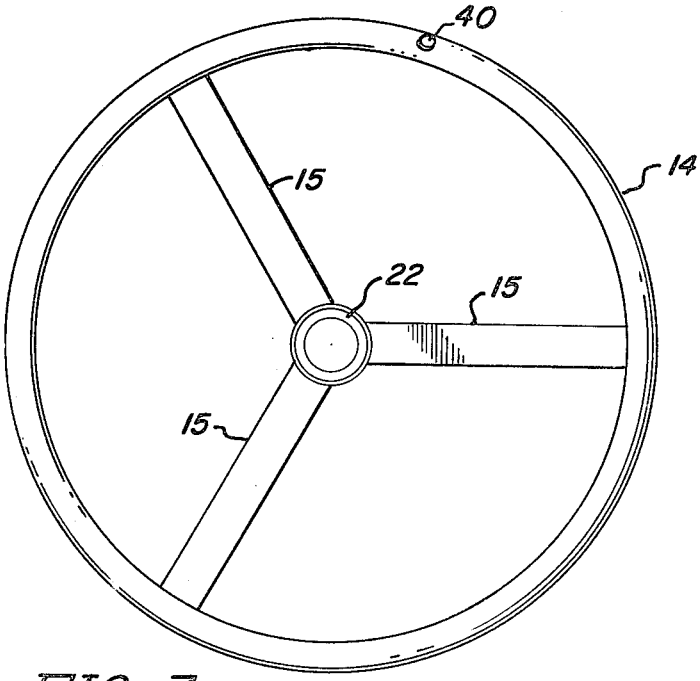
FIG. 7 is a top view of the flywheel of the present invention.

Flywheel 14 is rotatably mounted about the center of base plate 12 by means of a bearing assembly 22. Bearing assembly 22 consists of a plurality of ball bearings contained in the circumferential ring of bearing assembly 22. Bearing assembly 22 allows flywheel 14 to freely rotate about the center independent of the relative motion of treadle board 10. As hereinbefore described, since the roller assembly is affixed to one of the radial spokes 15 on flywheel 14, flywheel 14 will rotate in synchronism with the roller assembly. FIG. 7 illustrates a top view of flywheel 14, showing a preferred embodiment having three radial spokes 15. The center bearing assembly 22 is sized to conveniently fit circumferentially around bracket 42 or some similar bracket connection. The outer ring of flywheel 14 may be hollow and have an inlet hole 40 for adding sand or other dense material to increase the flywheel mass.

Figure 8:
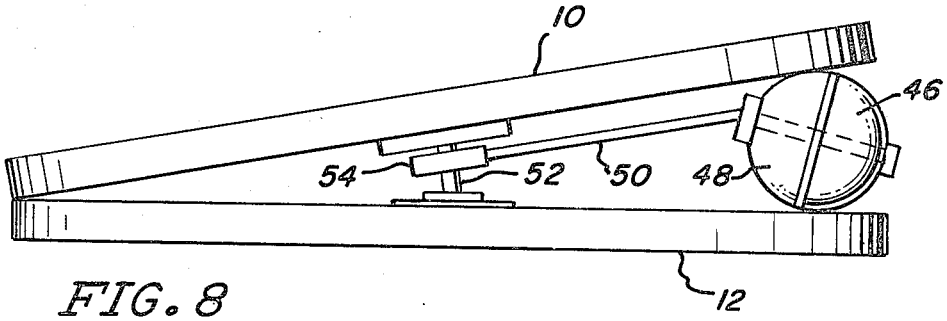
FIG. 8 illustrates yet another embodiment of the invention in side view.

FIG. 8 illustrates an alternative embodiment having similar operational characteristics with a different form of roller assembly. In this embodiment, a radial arm 50 is mounted about shaft 52 via a suitable bearing 54. Arm 50 is bent downwardly near its outer end and a pair of rotatable hemispherical balls 46 and 48 are mounted thereto. Hemisphers 46 and 48 have suitable bearings to enable them to freely rotate about arm 50, and the angle of arm 50 permits hemisphere 48 to bear against the under surface of treadle board 10 while hemisphere 46 bears against the upper surface of base plate 12. Hemisphers 46 and 48 are freely rotatable relative to radial arm 50 and also relative to themselves. Therefore, hemisphere 46 may rotate in one direction while bearing against base plate 12 and hemisphere 48 will rotate in the opposite direction while bearing against treadle board 10. This motion provides the same type of operation that is hereinbefore described for other constructional variations of the apparatus.

In operation it has been found that a person standing atop treadle board 10 may impart the desired wobble motion by bending and flexing his knees and lower legs in the manner similar to the motion used in downhill skiing. This motion provides the necessary degree of weight shifting for the apparatus to maintain a continuous wobble motion. Treadle board 10 rotates at a relatively slow angular rate about its center axis while flywheel 14 rotates at a much higher angular rate about the same axis. The direction of relative rotation between treadle board 10 and flywheel 14 is dependent upon the radial excursion of the treadle board in relation to the base plate due to the pitch angle of the treadle board, and the position of the spherical bearing relative to the treadle board and base plate. It is possible to adjust or select both the relative rotational direction and speed of treadle board 10 by adjusting the parameters above mentioned. Of course, the degree of wobble desired may be adjusted by merely selecting the height of the rollers on the roller assembly.

In its simplest embodiment, the apparatus may utilize a single roller bearing between treadle board 10 and base plate 12. However, greater stability has been found to be possible when multiple rollers are utilized in the configurations described herein, or in other similar configurations. Likewise, the apparatus may be designed without a flywheel 14, but the operation of the apparatus has been found to be improved through the use of a flywheel. Other varations and simplifications may be made to the design of various embodiments of the invention. The embodiments described herein being those preferred by the inventor.

What is claimed is:

1. An apparatus for imparting rotating and wobble motion to an operator, comprising:

a base member, a board member disposed above said base member and adapted to support an operator standing thereon, shaft means interconnecting said members for rotation and wobble motion of said board member relative to said base member about a predetermined axis of rotation, roller means disposed between and engaging both of said members at a radial position relative to said axis and angularly separating said members, and supporting means for said roller means, said supporting means being mounted for rotation about said axis whereby the impartation of downward force on said board member by the foot of an operator standing thereon causes said board member to rotate and wobble relative to said base member about said axis, further comprising flywheel means attached to said supporting means and rotatable therewith about said axis.

2. The apparatus of claim 1, wherein said flywheel means comprises an annular member attached to said supporting means and rotatable therewith about said axis, said annular member being radially disposed entirely outside the outermost preipheries of said base member and board member.

3. The apparatus of claim 2, including means for selectively varying the weight of said annular member.

4. The apparatus of claim 2, wherein said annular member has hollow portions adapted to receive ballast for increasing the weight of said annular member.

5. The apparatus of claim 1, and wherein said roller means includes a pair of rotatable hemispherical balls, said balls being freely rotatable relative to each other and to said supporting means, one of said balls engaging said base member and not engaging said board member, the other of said balls engaging said board member and not engaging said base member.

6. The apparatus of claim 5, including a supporting disc interposed between said board member and said base member, said supporting disc engaging and supporting said board member in point contact as said board member rotates and wobbles about said axis.

7. The apparatus of claim 1, wherein said roller means includes a first pair of rollers attached to said supporting means and in rotatable contact with said base member:

a second pair of rollers pivotally attached to said supporting means and in rotatable contact with said board member, and bushing means connected between said first pair of rollers and said second pair of rollers for dampening the pivotal action therebetween.

8. The apparatus of claim 1, including a supporting disc interposed between said board member and said base member, said supporting disc engaging and supporting said board member in point contact as said board member rotates and wobbles about said axis.

9. The apparatus of claim 1, wherein said roller means includes a first pair of rollers attached to said supporting means and in rotatable contact with said base member:

a second pair of rollers pivotally attached to said supporting means and in rotatable contact with said board member, and bushing means connected between said first pair of rollers and said second pair of rollers for dampening the pivotal action therebetween, including a supporting disc interposed between said board member and said base member, said supporting disc engaging and supporting said board member in point contact as said board member rotates and wobbles about said axis.

10. The apparatus of claim 1, including means for selectively varying the weight of said flywheel means.

11. The apparatus of claim 1, wherein said roller means includes a first roller attached to said supporting means and in rotatable contact with said base member, and a second roller pivotally attached to said supporting means and in rotatable contact with said board member, and bushing means connected between said first and second rollers for dampening the pivotal action therebetween.

12. The apparatus of claim 1, wherein said roller means includes a first roller attached to said supporting means and in rotatable contact with said base member, and a second roller pivotally attached to said supporting means and in rotatable contact with said board member.

13. The apparatus of claim 1, wherein said roller means includes a first roller attached to said supporting means and in rotatable contact with said base member, and a second roller attached to said supporting means and in rotatable contact with said board member.

14. The apparatus of claim 1, wherein said flywheel means comprises a circular member attached to said supporting means and rotatable therewith about said axis, said circular member being concentrically mounted about said shaft.

15. The apparatus of claim 14, wherein said circular member is radially disposed entirely outside the outermost peripheries of said base member and board member.

16. An apparatus for imparting rotating and wobble motion to an operator, comprising:

a base member, a board member disposed above said base member and adapted to support an operator standing thereon, shaft means interconnecting said members for rotation and wobble motion of said board member relative to said base member about a predetermined axis of rotation, roller means disposed between and engaging both of said members at a radial position relative to said axis and angularly separating said members, and supporting means for said roller means, said supporting means being mounted for rotation about said axis whereby the impartation of downward force on said board member by the foot of an operator standing thereon causes said board member to rotate and wobble relative to said base member about said axis, wherein said roller means includes a first pair of rollers attached to said supporting means and in rotatable contact with said base member, a second pair of rollers pivotally attached to said supporting means and in rotatable contact with said board member, and bushing means connected between said first pair of rollers and said second pair of rollers for dampening the pivotal action therebetween.

17. An apparatus for imparting rotating and wobble motion to an operator, comprising:

a base member, a board member disposed above said base member and adapted to support an operator standing thereon, shaft means interconnecting said members for rotation and wobble motion of said board member relative to said base member about a predetermined axis of rotation, roller means disposed between and engaging both of said members at a radial position relative to said axis and angularly separating said members, and supporting means for said roller means, said supporting means being mounted for rotation about said axis whereby the impartation of downward force on said board member by the foot of an operator standing thereon causes said board member to rotate and wobble relative to said base member about said axis, and including a supporting disc interposed between said board member and said base member, said supporting disc engaging and supporting said board member in point contact as said board member rotates and wobbles about said axis.

18. The apparatus of claim 9, wherein said roller means includes a first pair of rollers attached to said supporting means and in rotatable contact with said base member:

a second pair of rollers pivotally attached to said supporting means and in rotatable contact with said board member, and bushing means connected between said first pair of rollers and said second pair of rollers for dampening the pivotal action therebetween.

* * * * *